US006263577B1

(12) United States Patent
Wonderley

(10) Patent No.: US 6,263,577 B1
(45) Date of Patent: Jul. 24, 2001

(54) AUTOMATIC SPRING RETRACTABLE UTILITY KNIFE

(75) Inventor: Jeffrey W. Wonderley, Ft. Defiance, VA (US)

(73) Assignee: American Safety Razor, Verona, VA (US)

( * ) Notice: Subject to any disclaimer, the term of this patent is extended or adjusted under 35 U.S.C. 154(b) by 0 days.

(21) Appl. No.: 09/323,893

(22) Filed: Jun. 2, 1999

Related U.S. Application Data

(60) Provisional application No. 60/103,249, filed on Oct. 6, 1998.

(51) Int. Cl.[7] ..... B26B 5/00

(52) U.S. Cl. ..... 30/152; 30/154; 30/162; 30/335

(58) Field of Search ..... 30/152, 162, 154, 30/151, 329, 335

(56) References Cited

U.S. PATENT DOCUMENTS

| | | | | |
|---|---|---|---|---|
| D. 319,378 | | 8/1991 | Wilcox . | |
| 1,315,901 | | 9/1919 | Ballinger . | |
| 1,603,914 | | 10/1926 | Hermann . | |
| 1,864,011 | | 6/1932 | Brown . | |
| 3,063,147 | * | 11/1962 | Paparelli | 30/154 |
| 3,132,371 | | 5/1964 | Enos et al. . | |
| 3,192,624 | | 7/1965 | Gringer . | |
| 3,518,758 | * | 7/1970 | Bennett | 30/154 |
| 3,879,847 | | 4/1975 | Roll . | |
| 3,906,627 | | 9/1975 | Manning . | |
| 4,091,537 | * | 5/1978 | Stevenson, Jr. | 30/151 |
| 4,139,939 | | 2/1979 | Crooks . | |
| 4,242,795 | | 1/1981 | Rollband et al. . | |
| 4,604,805 | | 8/1986 | Kreiger . | |
| 4,621,425 | | 11/1986 | Stoutenberg . | |
| 4,761,882 | * | 8/1988 | Silverstein | 30/162 |
| 4,835,865 | | 6/1989 | Knoop . | |
| 5,012,581 | | 5/1991 | Fletcher et al. . | |
| 5,025,558 | | 6/1991 | Gilbert . | |
| 5,031,322 | | 7/1991 | Jacoff . | |
| 5,121,544 | | 6/1992 | Gilbert . | |
| 5,164,871 | | 11/1992 | Hughes et al. . | |
| 5,230,152 | | 7/1993 | Kennedy . | |
| 5,258,001 | | 11/1993 | Corman . | |
| 5,301,428 | | 4/1994 | Wilcox . | |

(List continued on next page.)

FOREIGN PATENT DOCUMENTS 35 20 187 A1 12/1986 (DE) .

*Primary Examiner*—Rinaldi I. Rada
*Assistant Examiner*—Kim Ngoc Tran
(74) *Attorney, Agent, or Firm*—McDermott, Will & Emery

(57) ABSTRACT

To automatically retract the blade after cutting, a flat serpentine spring is integrally formed with a thumb piece which is slidably received in a slot formed along the upper edge of a housing/handle. The housing has a finger rest projection on the lower edge to facilitate cutting while the blade is projected with the thumb. The two halves of the housing snap together using a block-like projection formed on one half, and a pair of tabs formed on the other. The tabs, which are resilient, slide along the sides of the projection until recesses on each of the side of the projection are reached. Inwardly extending ridges on the ends of the tabs enter the recesses to provide a click lock. An aperture between the tabs allows pressure to be applied to the top of the projection to separate the two halves for blade reset/re-adjustment. The blade carrier, which is adapted to support two different types of blades, is slidably mounted in the housing so that it and the thumb piece are free of detents or click-locks. The carrier's upper and lower edges have a number of apertures to permit setting in different orientations and adjustable positioning with respect to an engaging projection on the base of the thumb piece. This, and the ability to set at least one of the blades in a plurality of different positions on the carrier, allows blade projection adjustment.

18 Claims, 15 Drawing Sheets

U.S. PATENT DOCUMENTS

| | | | | |
|---|---|---|---|---|
| 5,386,632 | * | 2/1995 | Schmidt | 30/125 |
| 5,481,804 | | 1/1996 | Platts . | |
| 5,495,670 | * | 3/1996 | Quinn | 30/162 |
| 5,528,832 | * | 6/1996 | Schmidt | 30/169 |
| 5,581,890 | | 12/1996 | Schmidt . | |
| 5,603,162 | * | 2/1997 | Chen | 30/162 |
| 5,617,635 | * | 4/1997 | Berns | 30/162 |
| 5,644,843 | * | 7/1997 | Young | 30/124 |
| 5,813,121 | | 9/1998 | Gringer . | |
| 5,868,771 | * | 2/1999 | Herbert et al. | 30/162 |
| 5,870,828 | * | 2/1999 | Polites | 30/162 |
| 5,924,203 | * | 7/1999 | Huang | 30/142 |
| 5,960,544 | * | 10/1999 | Beyers | 30/125 |

* cited by examiner

AUTOMATIC SPRING RETRACTABLE UTILITY KNIFE

CROSS-REFERENCE TO RELATED APPLICATIONS

This application claims priority from Provisional Patent Application Ser. No. 60/103,249 filed on Oct. 6, 1998, entitled AUTOMATIC SPRING RETRACTABLE UTILITY KNIFE. The content of this Provisional Patent Application is hereby incorporated by reference thereto.

BACKGROUND OF THE INVENTION

1. Field of the Invention

The present invention relates generally to utility knives and more specifically to a spring loaded utility knife wherein the blade is constantly biased toward a retracted position so that upon the removal of manual pressure holding the blade in an exposed cutting position, the blade is automatically retracted to a non-exposed position under the bias of the spring.

2. Discussion of the Related Art

A number of utility knives have been proposed which have blade is arranged within a housing and arranged to project by an amount suitable for cutting paper, tape and the like. While these type of knives have found considerable utility, there has been a problem that the blade does not automatically retract upon the cutting operation being completed and requires that the operator take steps to have the blade move back within the housing of the device. One such device is disclosed in U.S. Pat. No. 5,813,121 issued on Sep. 29, 1998 in the name of Gringer. This device is such as to feature a side mounted slider which projects out of one side of the handle or housing and includes a series of positions in which the blade can be locked in a projected state. Due to the arrangement of the thumb piece being located on one side of the housing, this arrangement is limited to use by right handed people. Further, in the embodiments wherein a serpentine spring is used to retract the blade upon a lock mechanism is released, the spring, the blade carrier, the lock mechanism and the thumb piece are all integrally formed. The molding process required to achieve the production of this element is, of course, complex adding to the production cost. It further prevents the position/orientation of the blade carrier within the handle or housing from being varied to permit the use of differently shaped cutting blades and limits the degree to which the amount of projection of each blade can be adjusted in accordance with the task in hand.

U.S. Pat. No. 5,581,890 issued on Dec. 10, 1997 in the name of Schmidt, discloses a utility knife which permits the blade to be retracted back into the housing automatically upon the removal of manually applied pressure on a thumb piece. Nevertheless, this arrangement is provided with a rack on the interior of the housing and a projection on the blade carrier which is adapted to engage the rack in a kind of ratchet type of arrangement. This of course inhibits the change of the blade carrier orientation within the housing and thus prevents the use of a variety of different types of blades in the same device.

A further drawback that both of the above arrangements suffer from is the manner in which the two halves of the handles interconnect with one another. While the arrangement in U.S. Pat. No. 5,813,121 attempts to render the halves readily disengageable from one another via the provision of a latch member which is mounted on a flexible portion and arranged to bent via the application of a digit such as the operator's thumb, the arrangement tends to be relative fragile and apt to fail after a large number of operations. The arrangement disclosed in U.S. Pat. No. 5,581,890, on the other hand, is such as to use a barbed member which snaps into a locking position once inserted sufficiently through an aperture formed in the other half. In this arrangement the ability to separate the two halves has not been given much consideration tends to be difficult to separate once they are engaged with one another.

Accordingly, there exists a need for a utility knife which is readily separable into its two halves, which has an engaging mechanism which is robust and which is not apt to fail after a relatively small number of operations, and which allows for a variety of different blades to be mounted and used in accordance with the desires of the user.

SUMMARY OF THE INVENTION

The present invention therefore is such as to feature a housing which has a unique engagement arrangement which is both robust and which allows with a simple press of the thumb, the two halves to be force apart to a state where disassembly of the knife is facilitated and quick and easy blade replacement/adjustment is rendered possible.

The present invention further features a blade carrier which is disposed in the housing and which can be, once the housing is popped open, adjusted with respect to an engaging portion formed on a thumb pieces to adjust the maximum amount of blade projection, or inverted so as to accommodate a different type of blade and allow for different cutting operations.

A further feature of the present invention is the ability to store spare blades within the housing, so that when the two halves are separated, switching from one type of blade to another is sped up in that the new and desired blade is immediately on hand and as such no searching about for the same is necessary.

Yet another feature of the present invention is the provision of a finger guard which is located on the lower edge of the housing. This guard allows the operator to place his or her index finger in a position wherein it is prevented from accidentally sliding forward toward the blade when projected In brief, the present invention is such that, in order to automatically retract the blade after cutting, a flat serpentine spring is integrally formed with a thumb piece which is slidably received in a slot formed along the upper edge of a housing/handle. The housing has a finger rest projection on the lower edge to facilitate cutting while the blade is projected with the thumb. The two halves of the housing snap together using a block-like projection formed on one half, and a pair of tabs formed on the other. The tabs, which are resilient, slide along the sides of the projection until recesses on each of the side of the projection are reached. Inwardly extending ridges on the ends of the tabs enter the recesses to provide a click lock. An aperture between the tabs allows pressure to be applied to the top of the projection to separate the two halves for blade reset/re-adjustment. The blade carrier, which is adapted to support two different types of blades, is slidably mounted in the housing so that it and the thumb piece are free of detents or click-locks. The carrier's upper and lower edges have a number of apertures to permit setting in different orientations and adjustable positioning with respect to an engaging projection on the base of the thumb piece. This, in combination with the ability to set at least one of the blades in a plurality of different positions on the carrier, allows a high degree of blade projection adjustment.

More specifically, a first aspect of the present invention resides in a utility knife including a manually grippable housing comprised of first and second halves. The first and second halves cooperate to define an enclosed space therebetween and include connection means for permitting the first and second halves to be releasably connected to one another comprising: a) a shaped projection which is rigid with the first half; and b) a pair of resilient tabs formed on the second half, the pair of tabs extending along opposed sides of the projection to frictionally engage the opposed sides of the projection and hold the first and second halves together.

The above-mentioned connection means includes recessed portions formed in the sides of the projection in which ridge portions on the pair of tabs, are detachably received, and further comprises an aperture formed in the second half through which a top surface of the projection is exposed for manual manipulation and displacement of the projection away from the second half when disconnection of the first and second halves is required.

A blade carrier is disposed in the enclosed space and arranged to be slidable along elongate guide surfaces which project from at least one of the first and second halves. This blade carrier is adapted to receive two different blades and is disposable on the elongate guide surfaces in two distinct orientations. The blade carrier is adapted to support a cutting blade in a plurality of positions. In fact the blade, which is supported on the blade carrier, can be, in the instance its construction permits, set on the blade carrier in at least two different positions which determine the degree of projection of the blade from the housing when the blade carrier is manually urged to a blade extending position.

A thumb piece is slidably disposed in an elongate opening formed along an upper edge of the housing, and is detachably connectable with the blade carrier through a plurality of connection sites formed on one of the thumb piece and the blade carrier to allow the relative position of the blade carrier with respect to the thumb piece to be adjustable and for the degree of projection of a blade mounted on the blade carrier from the housing when thumb piece is moved to one end of the elongate opening, to be selectively varied. A spring is connected to one end of the thumb piece and is connectable at a second end to a portion of one of the first and second halves. In fact, in the preferred arrangement, the spring is unitarily connected with the thumb piece and has a flat serpentine configuration.

In one embodiment of the invention the serpentine spring has a plurality of inflexion portions at which the direction of the spring changes. Each of these inflexion portions has a dimension which is greater than the corresponding dimension of the portions of the spring which extend between and interconnect each of the inflexion portions.

In accordance with the preferred operation at least one of the thumb piece and the blade carrier are slidably supported by the housing so as to be smoothly slidable and free of engagement with detent or click lock structures and thus automatically and unimpedely biased to a blade retracting position under the influence of the spring when manual pressure on the thumb piece is absent. In addition to this the first and second halves of the housing are shaped to form a finger rest which is located on a lower edge of the housing so as to be approximately opposite the thumb piece when the thumb piece is maximally moved toward a front portion of the housing from which the blade projects. To render the housing more aesthetically appealing and to permit the type of blade to ascertained at a glance one of the first and second halves are made of a transparent material.

In accordance with a second aspect of the invention, a utility knife has a housing comprised of first and second halves which are detachably connectable to one another to form a housing. The halves are adapted to slidably support a blade carrier therein. This blade carrier is configured so that it can be rotated through 180° from a first position wherein a first type of blade can be operatively set thereon, to a second position wherein a second type of blade which is different from the first, can be operatively set thereon.

A thumb piece which is slidably supported in the housing has a projection which engages in a selected one of a plurality of connection apertures are formed along opposed sides of the blade carrier in a manner which adjusts the relative position between the thumb piece and the blade carrier when the thumb piece is in drive connection with the blade carrier. A finger rest is located on a lower edge of the housing so as to be approximately opposite the thumb piece when the thumb piece is maximally moved toward a front portion of the housing from which the blade projects.

A flat serpentine spring has one end rigidly connected to the thumb piece and a second end detachably connected to a connection member on an interior surface of one of the first and second halves of the housing. This spring has a plurality of inflexion portions at the locations where the direction of the spring changes, the inflexion portions having at least one structural dimension which is greater than the corresponding dimension of the portions of the serpentine spring which extend between and interconnect the inflexion portions. Further, the spring is arranged to elongate in the longitudinal direction of the housing and is such that the at least one structural dimension is a width dimension taken at right angles to the direction in which the spring elongates.

One of the first and second halves is made of a transparent material so that the serpentine spring can be observed therethrough.

A third aspect of the invention resides in a utility knife having first and second halves which are detachably connected to one another to form a housing, and a blade carrier slidably disposed in the housing, comprising: a flat serpentine spring which is disposed in the housing, the serpentine spring having a plurality of inflexion portions at the locations where the direction of the spring changes, the inflexion portions having at least one structural dimension which is greater than the corresponding dimension of the portions of the serpentine spring which extend between and interconnect the inflexion portions, the flat serpentine spring being separate from the blade carrier and connected thereto through an intermediate member. The intermediate member is a thumb piece which is slidably disposed along an upper minor edge of the housing, the thumb piece being unitarily connected to one end of the serpentine spring.

A further aspect of the invention resides in a blade carrier, which features a flat plate-like blade support member; upper and lower blade-retaining edge members which extend normally from the upper and lower edges of the blade support member, at least one of the upper and lower edges being adapted to engage and slide along a guide member; a plurality of engagement recesses formed in both of the upper and lower edge members; first positioning projection adapted to engage in a notch formed in an upper edge of a first type of blade, the first positioning projection being contiguous with the upper edge members; and a second positioning projection adapted to engage an opening formed in a central portion of a second type of blade.

The first positioning projection is located between the positioning recesses formed in the upper edge member and a first end of the blade holder and the second positioning projection is located proximate to a second end of the blade holder and spaced from both the upper and lower edges of the blade support member. The first blade is a trapezoidally-shaped member in which the plurality of recesses are formed along an upper edge which is shorter than an opposite edge along which the cutting edge is formed, while the second blade is a rectangularly-shaped blade and wherein the opening in the central portion thereof is elongate in a direction essentially normal to a cutting edge.

Each of the plurality of engagement recesses formed in the upper and lower edge members are adapted to engage a projection formed on a manually operable member in a manner to establish a drive connection between the blade carrier and the manually operable member. In fact, the engagement recesses in the upper and lower edges can be so located with respect to one another that the blade carrier is rotatable through 180° and disposable in a position wherein drive connection between the manually operable member and the blade carrier can be re-established.

A major surface of the carrier is imprinted with a plurality of blade icons which respectively indicate the location and orientation of a plurality of blades that can be disposed on the carrier, and the blade carrier is adapted for disposition in a housing so as to be smoothly and unimpedely slidable therein in a manner which is free of engagement with detent or click lock structures.

BRIEF DESCRIPTION OF THE DRAWINGS

The various features and advantages of the present invention will become more clearly appreciated as a detailed description of a preferred embodiment of the present invention is given with reference to the appended drawings in which.

DETAILED DESCRIPTION OF THE PREFERRED EMBODIMENTS

Figure 1:
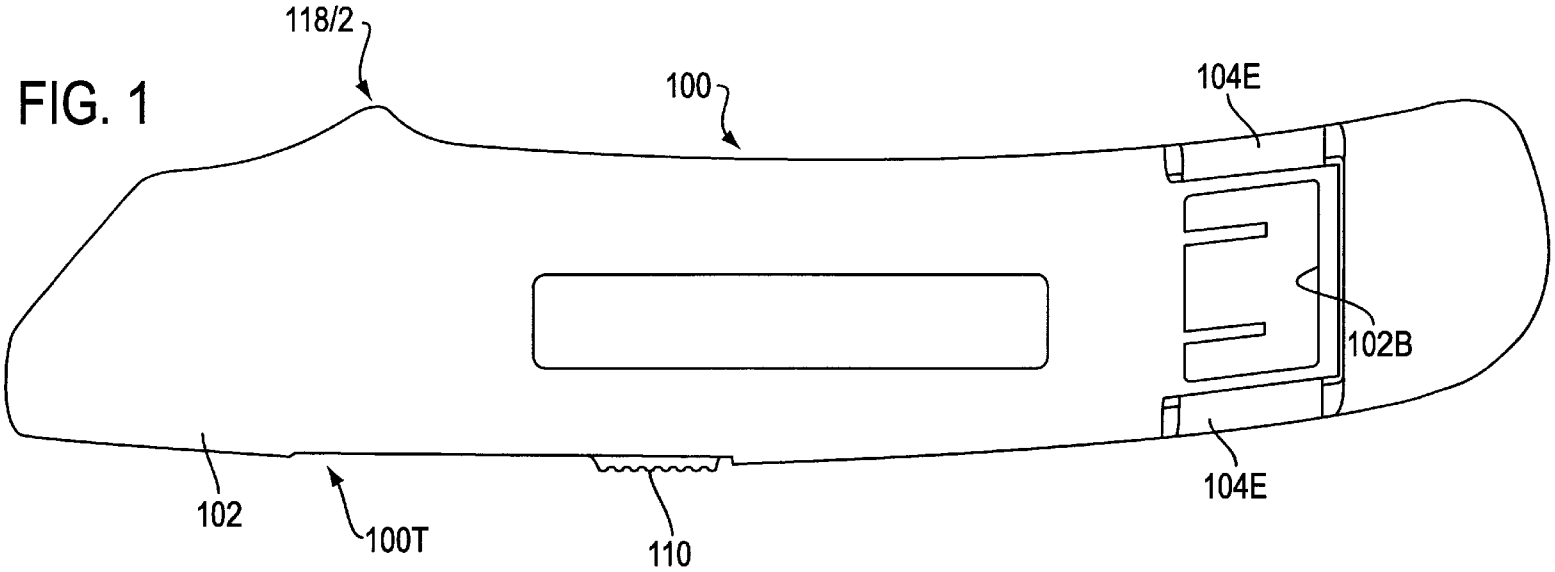
FIGS. 1 to 3 are corresponding side—top plan—side views of a fully assembled embodiment of a utility knife according to the present invention.
Figure 2:
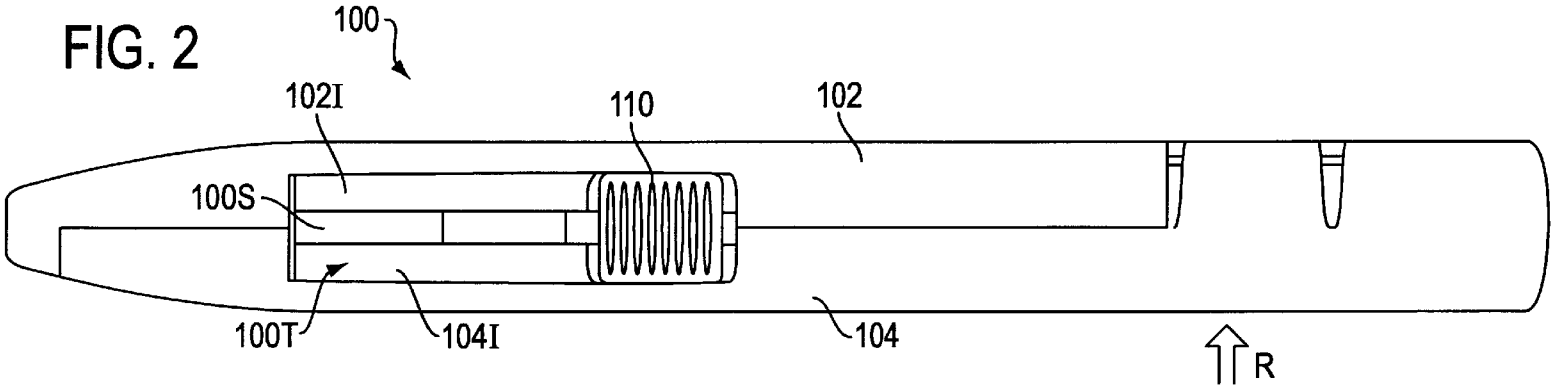
Figure 3:
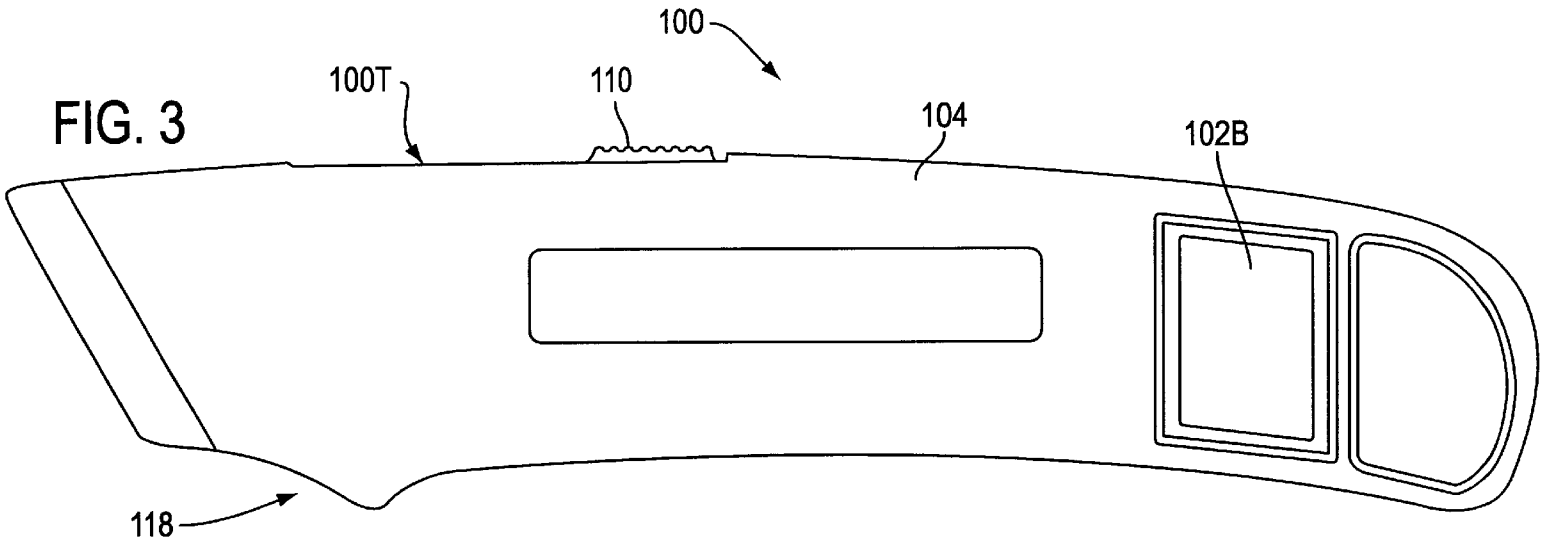
Figure 4:
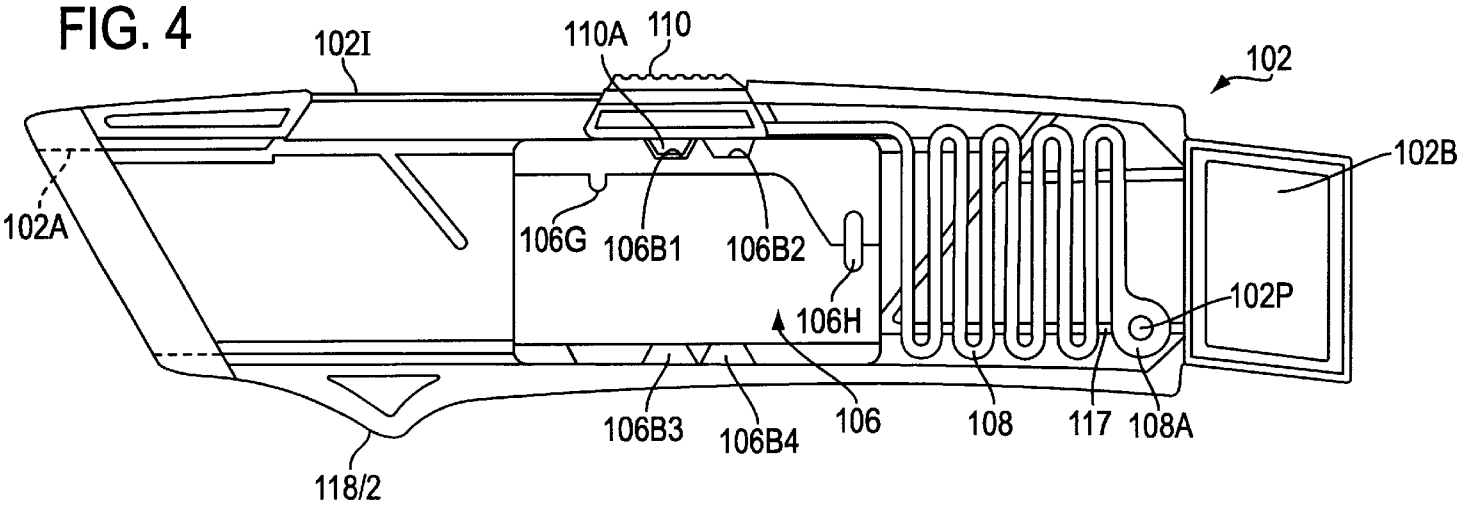
FIG. 4 is a side view of a first half of the utility knife showing manner in which a blade carrier, serpentine spring and associated thumb piece are arranged therein.

FIGS. 1–3 show an assembled utility knife housing 100 which comprises first and second halves 102, 104. The first half 102 is, as shown in FIG. 4, arranged to receive a blade carrier 106, and an serpentine spring 108 and thumb piece 110. It will be noted at this point that even though the spring 108 and thumb piece 110 are in fact unitarily formed as one piece in the preferred embodiment, each member will be assigned different numerals and will be referred to as separate elements for the sake of disclosure clarity.

Figure 8:
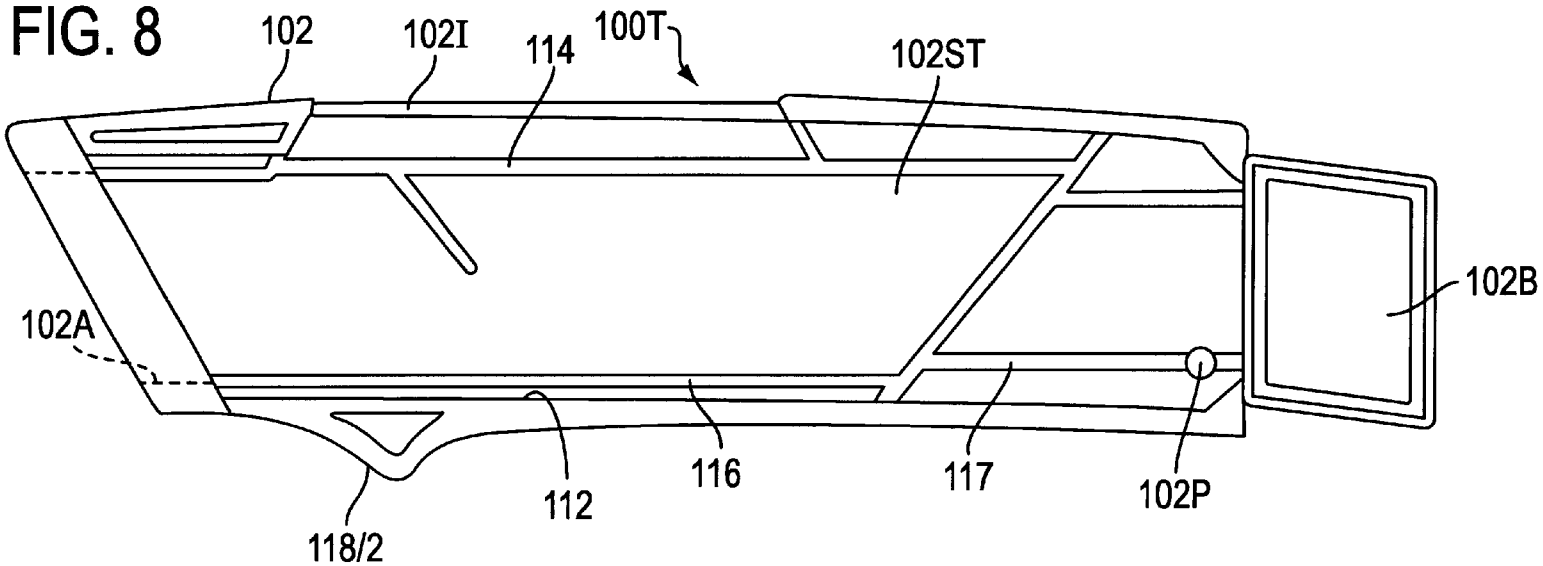
Figure 9:
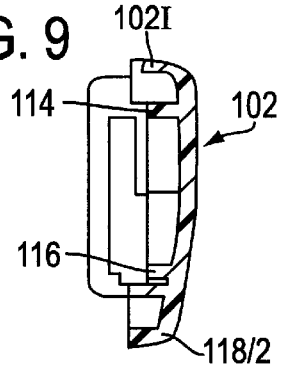
FIGS. 9 to 12 are sectional views taken along the length of the first half of the housing.
Figure 10:
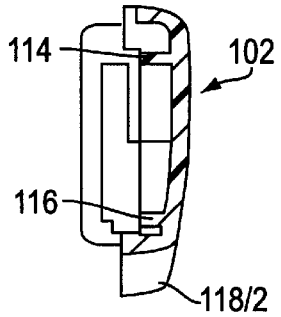
Figure 11:
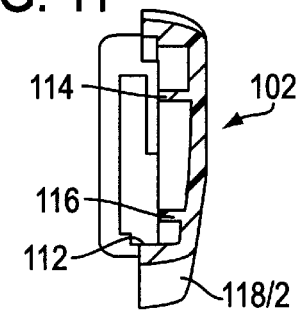
Figure 12:
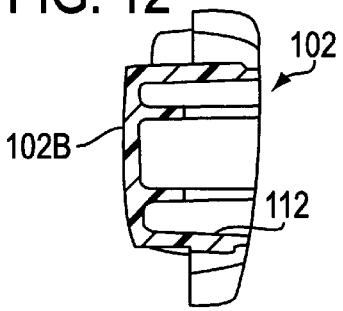
Figure 27:
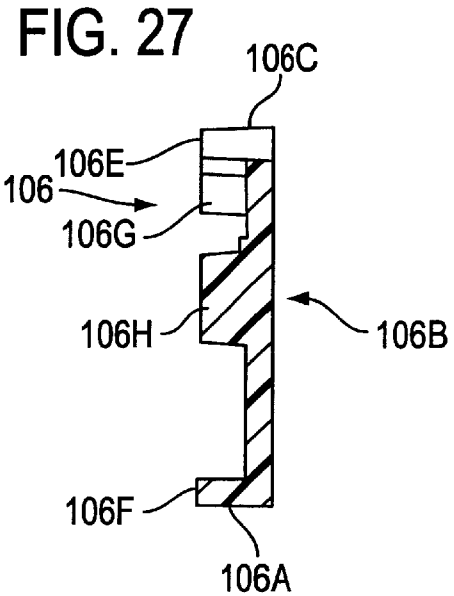
FIG. 27 is a sectional view as taken along section line 27—27 of FIG. 26.
Figure 25:
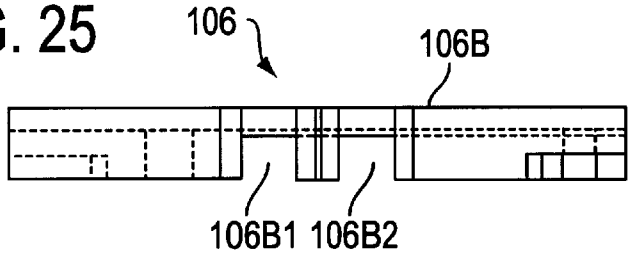
FIGS. 25 and 26 are respectively top and side views of the blade carrier which is engageable with a portion of the thumb piece.
Figure 26:
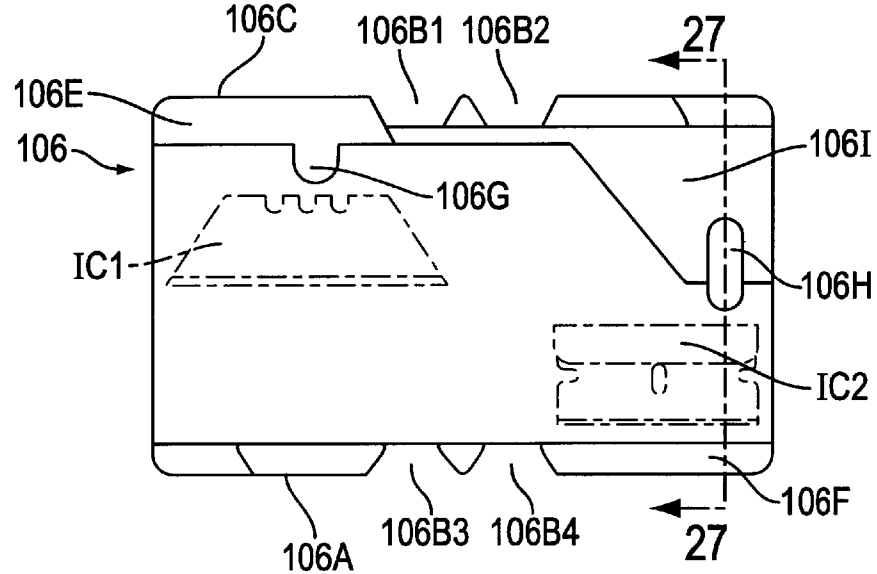
Figure 28:
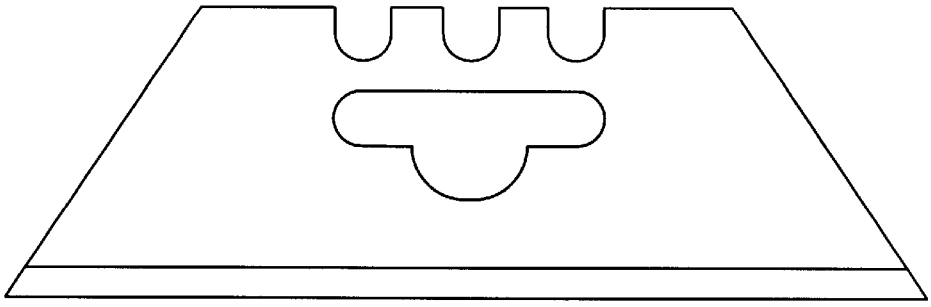
FIGS. 28 to 33 and FIGS. 34 and 35 are side views of examples of blades which can be used with the utility knife according to the present invention.
Figure 29:
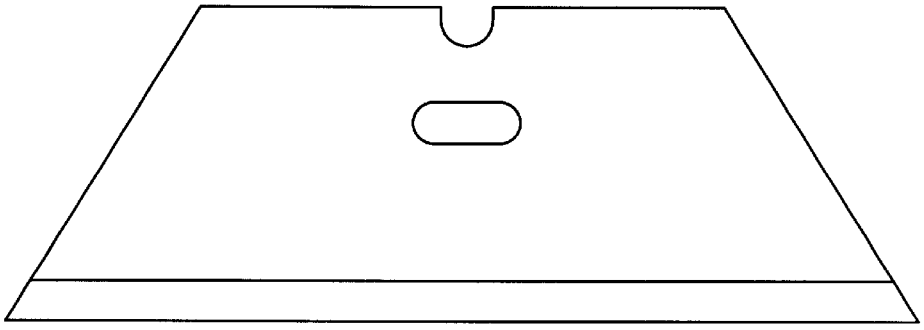
Figure 30:
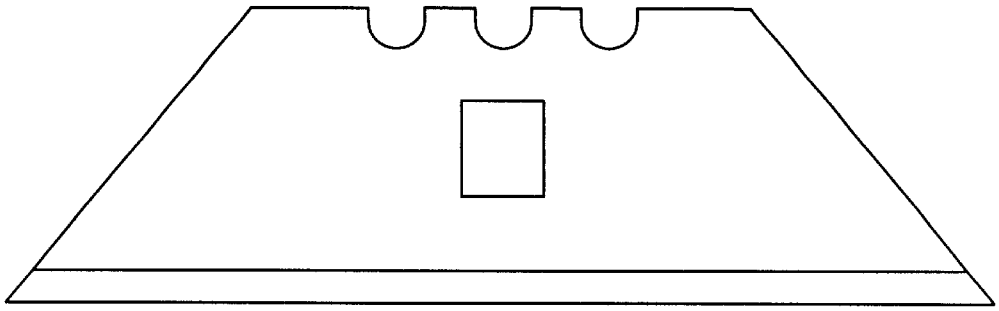
Figure 31:
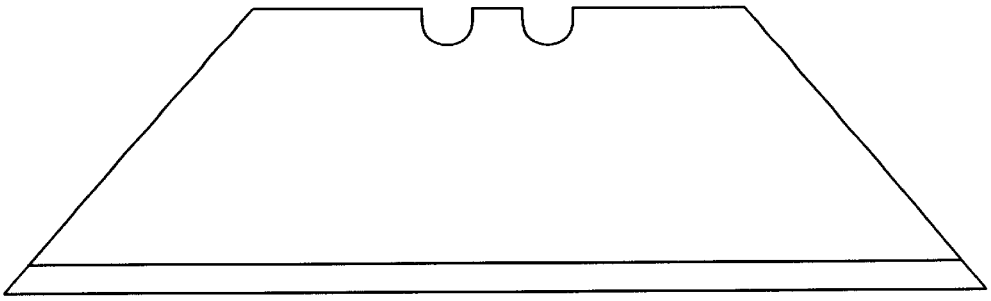
Figure 32:
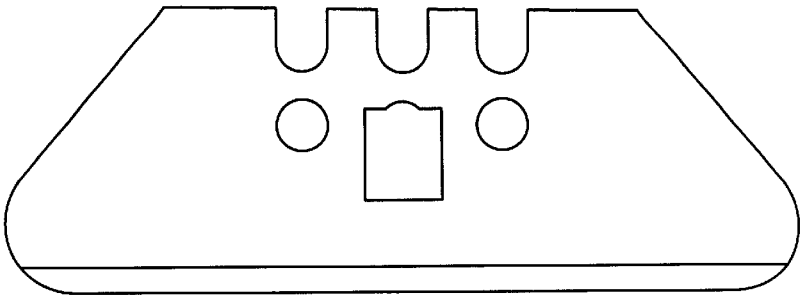
Figure 33:
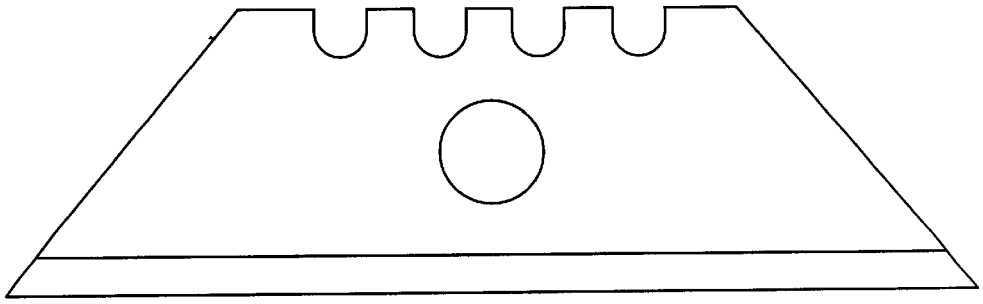

The blade carrier 106, the construction of which is best seen in FIGS. 25–27, is arranged to be slidable within the housing 100 and is arranged to travel along guide surfaces which are best seen in FIG. 8. The lower guide surface 112 is arranged to engage the lower minor edge 106A of the blade carrier, while the inboard minor edges of upper and lower guide ribs 114, 116, are arranged to engage what shall be referred to as the rear major surface 106B of the carrier 106.

As will be appreciated from FIG. 4, these upper and lower guide ribs 114, 116 are such as to engage the rear major surface 106B of the blade carrier at locations which are proximate the upper and lower edges thereof. A detailed description of the structure provided on the front major surface of the carrier will discussed hereinlater with reference to FIGS. 25 and 26, along with the manner in which different types of blades can be operatively and adjustably mounted thereon.

The serpentine spring 108 is provided with a connection boss 108A at one end. A through hole which is formed in this boss 108A is adapted to receive a circular cross section pin 102P which is, as best seen in FIG. 8, formed on the inner wall of the first half proximate the rear end thereof. In this embodiment, the thumb piece 110 is unitarily formed at the leading end of the spring.

The configuration of this spring 108 and the thumb piece 110 are shown in FIGS. 21–24. It will be noted that while the top of the thumb piece is illustrated as being relatively flat throughout most of the figures, it is possible to modify the shape of this element as the need to vary the engagement with the thumb surface of the operator, occurs. Merely by way of example, the surface of the thumb piece 110 can be increased in the manner illustrated in phantom in FIG. 22, in the event that it is required to enable the operator to be able to increase the amount of forward thrust during use.

Figure 36:
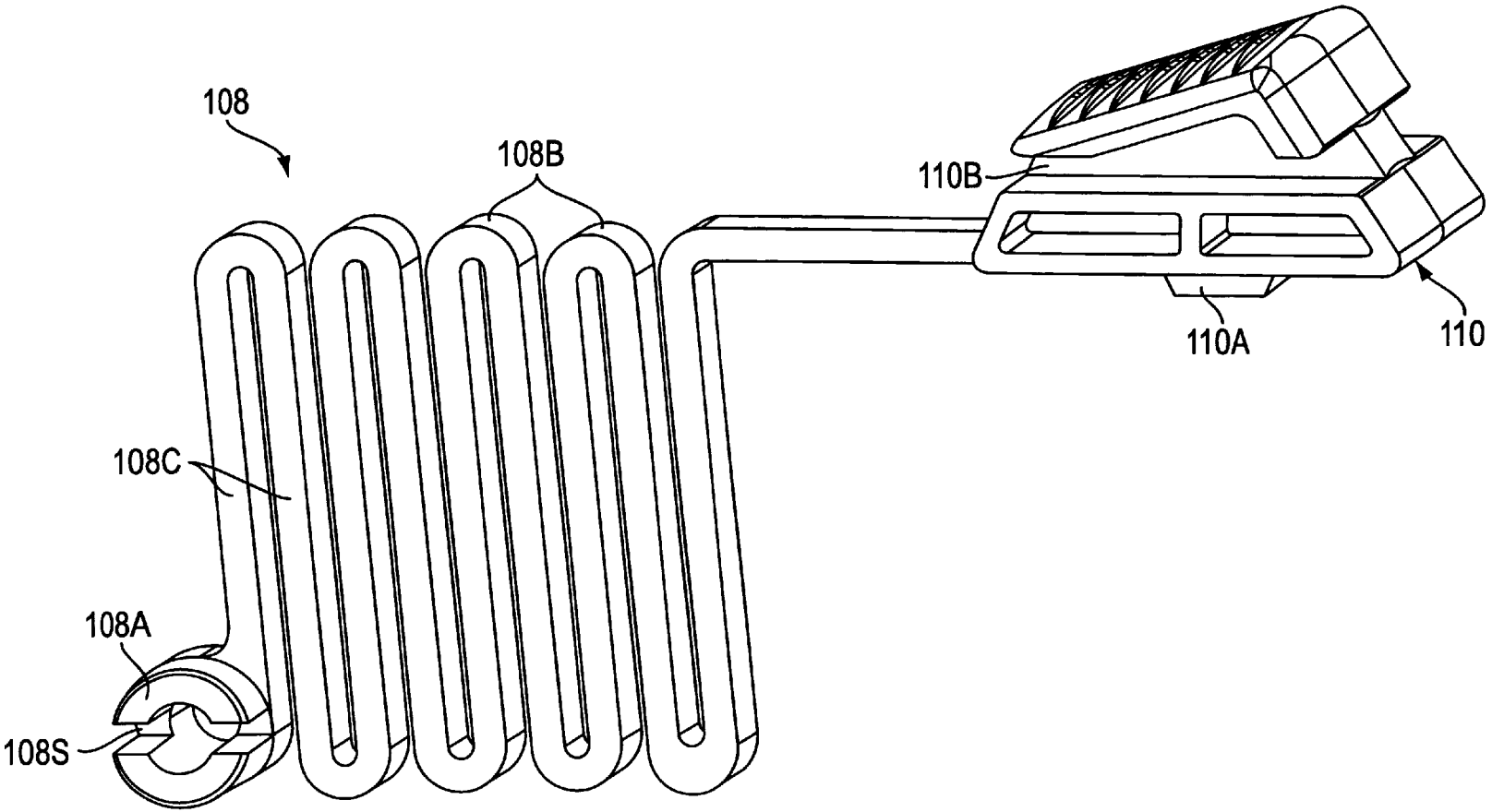
FIG. 36 is a perspective view of the integral thumb piece and serpentine spring depicted in FIGS. 21 and 22, showing a slot which is formed in the boss at the rear end of the spring for preventing relative rotation between the boss and the pin on which it is mounted.

Further, as shown in FIG. 36, the boss 108A is formed with a slot 108S which is sized to receive rib 117 with which pin 102P is integrally formed (see FIG. 8). The engagement between the rib 117 and the boss 108A prevents the relative rotation of the boss 108A about the pin 102P when the serpentine spring 108 is elongated via the application of manual force to the thumb piece 110. The provision of the slotted boss 108A is thought to prolong the working life of the spring.

The lower surface of the thumb piece 110 is formed with an engagement projection 110A. This projection 110A is adapted to be received in one of a number (two in this embodiment) of engagement recesses 106B1, 106B2, which are formed along the upper minor edge 106C of the blade carrier. While being normally well received in the selected one of the engagement recesses, the engagement projection 110A is driven down into position by the force which is applied to the thumb piece 110 during the operation of the knife.

The sides of the thumb piece 110 are formed with guide grooves 110B which are arranged to receive the inwardly extending wall portions 1021, 1041 which extend along the sides of a slot 100S which is formed in the upper minor surface of the housing 100 and in which the thumb piece is adapted to slide. This slot 100S extends along the middle of a shallow trench denoted by the numeral 100T.

Figure 24:
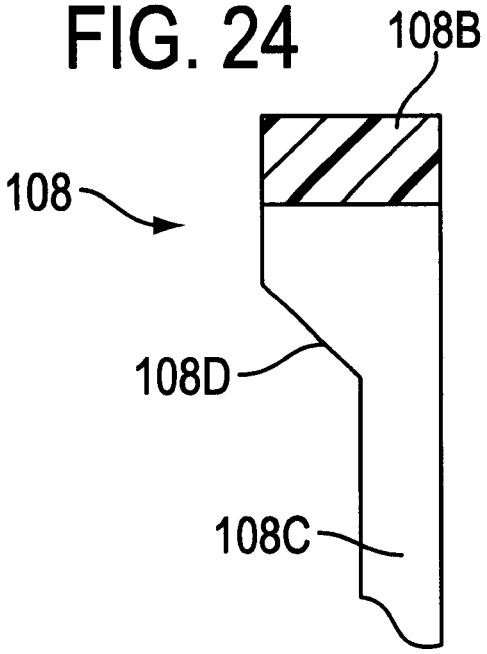

The flat windings of the serpentine spring 108 are arranged so that the curved inflexion portions 108B of the spring have a greater lateral thickness than the portions 108C of the spring which extend therebetween. In fact, as seen in FIG. 24, in this embodiment, one side of the spring 108 is formed flat while the other side is such as to exhibit an almost 100% change in thickness. The shoulder or inflexion portions 108A are close to, if not about twice as thick when taken laterally, as the connecting members 108C. A tapered section 108D interconnects the thick and thin portions as shown.

This configuration not only facilities the provision of the rigidifying guide ribs 104A, 104B which are formed in the second half 104 of the housing, by effectively providing a channel in which they may be received, but also increases the strength and longevity of the portions (viz., inflexion portions 108B) of the spring 108 which undergo considerable deformation/flexure during the operation of the knife.

The various other modifications which are possible with the above-described spring and thumb-piece construction/arrangement will be readily self-evident to the person skilled in the art to which this invention pertains and as such no further disclosure is deemed necessary and will be accordingly omitted for brevity.

Figure 5:
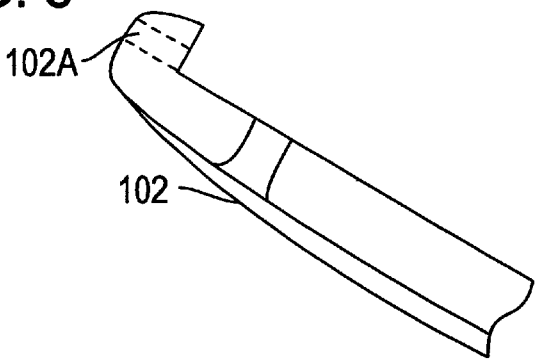
FIG. 5 is a partial sectioned view of the leading end of the first half showing the slot which enables the leading halves of the two members which go to make up the body of the utility knife, to engage one another.
Figure 6:
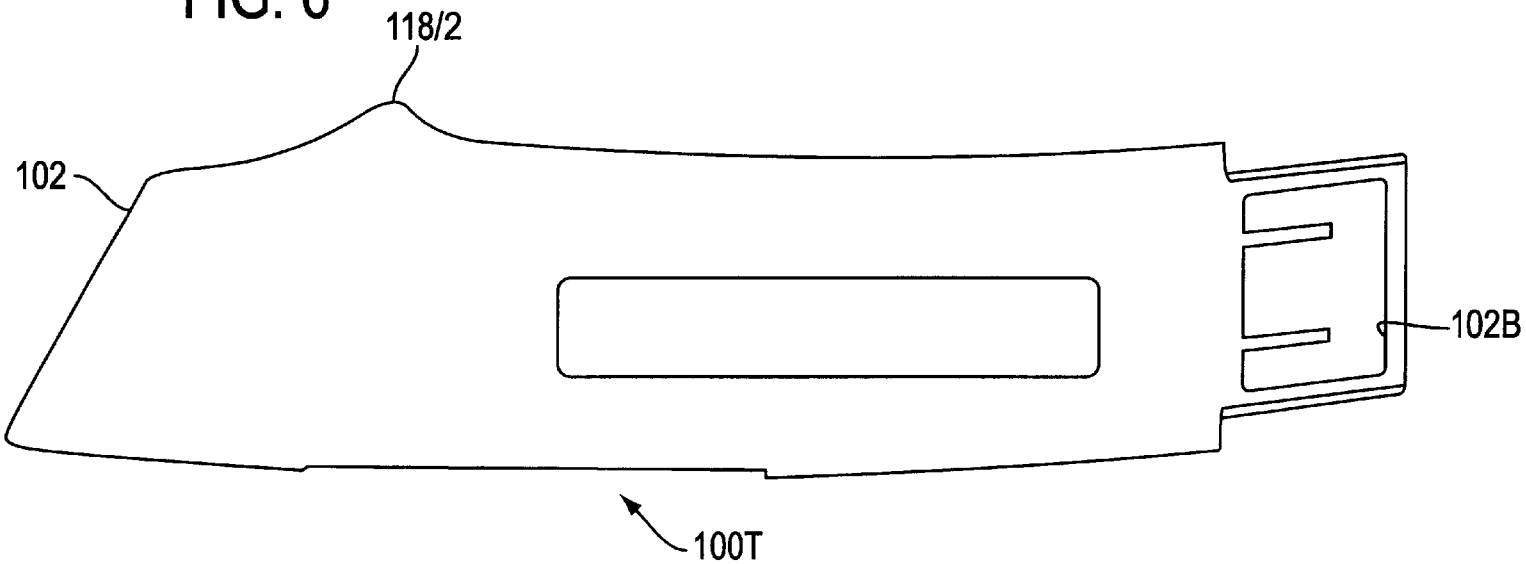
FIGS. 6, 7 and 8 are corresponding side—top plan—side views of the first half of the housing/handle.
Figure 13:
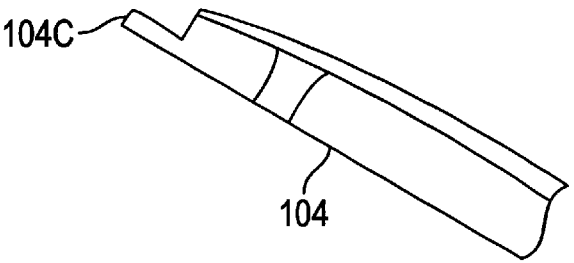
FIG. 13 is a view showing the leading end of the second half of the utility knife housing depicting the tang which is provided at the leading end of the second half and which is adapted to engage in the slot shown in FIG. 5.

The two halves 102, 104 of the housing are interconnected using a unique connection arrangement. The forward end of the first half 102 is formed with a slot 102A (see FIG. 5) while the corresponding forward end of the second half 104 is provided with a tang 104C(see FIG. 13) which is adapted to slid into the recess or slot 102A to establish a connection at the forward or leading end of the housing.

The rear end of the first half 102 is formed with a rectangular push-button-like projection 102B. The top of this projection 102B is sized so that it may be readily pressed with a thumb or digit of an operator's hand during a disconnection operation. The second half 104, on the other hand, is formed with an opening 104D into which the projection may enter and subsequently be received. Two clasper-like tabs 104E which are resilient, are formed on either side of the opening or aperture and are arranged to frictionally engage the sides of the projection 102B as the projection 102B is moved toward and into the opening.

Figure 7:
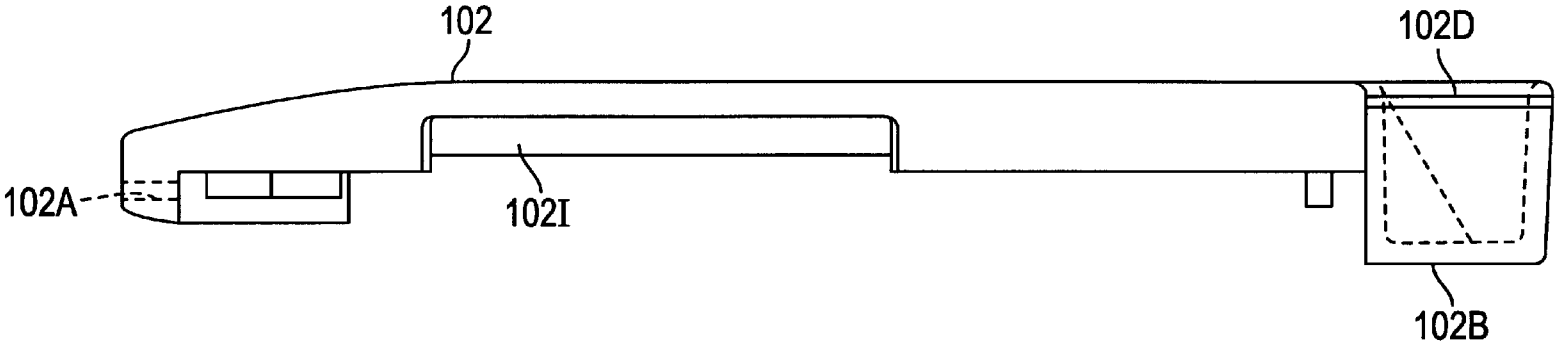

The ends of the tabs 104E are formed with small inwardly extending ridges 104R. These are arranged to slide on the sides of the projection 102B until the projection 102B is almost completely received in the opening 104D and the two halves 102, 104 of the housing 100 are essentially in full engagement with each other. At this time, the ridges 104R snap into recesses 102D (see FIG. 7) which are formed on opposite sides of the projection 102B and produce a click-lock effect which binds the two halves 102, 104 snugly together.

When it is desired to separate the first and second halves, all that is necessary is for an operator to press on the top of the projection 102B, which is clearly accessible from the second side of the housing as clearly illustrated in FIG. 3, and apply a force acting in the direction shown by arrow R (release) in the depicted in FIG. 2. The application of this force R is such as to move the projection 102B away from the second half 104 and induce the ridges 104R to ride up out of the recesses 102D and re-engage the sides of the projection 102B. Once this click-lock is released, the projection 102B is able to slide with the tabs 104E frictionally engaging its sides to permit the two halves 102, 104 to smoothly separate from one another until such time as disengagement between the same is stably achieved.

Figure 14:
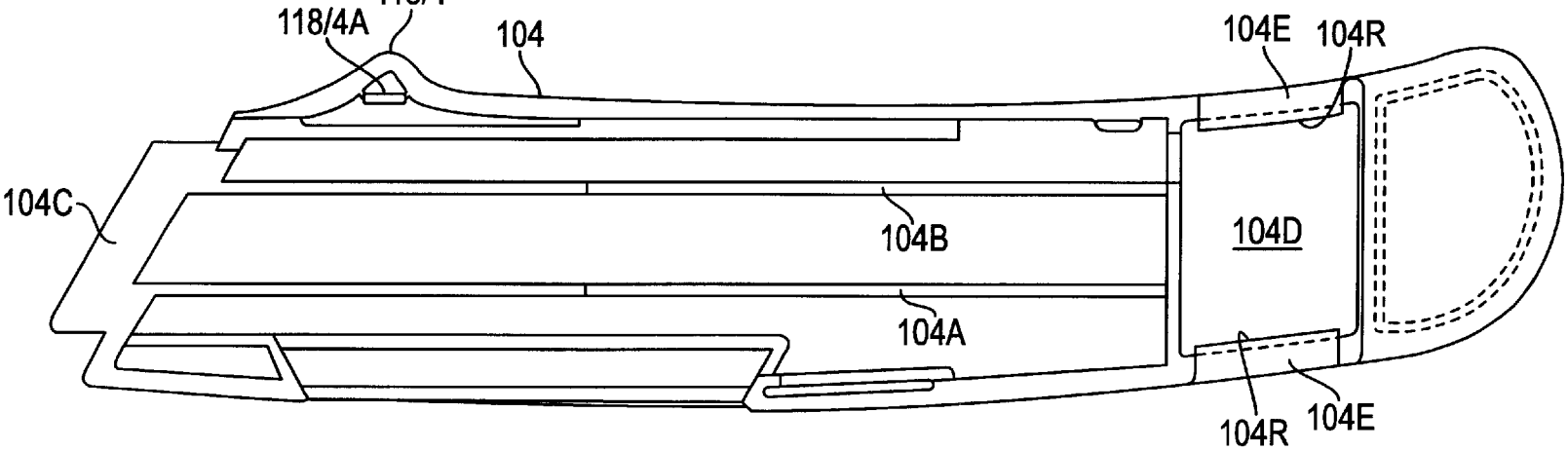
FIGS. 14, 15 and 16 are corresponding side—plan—side views of the second half of the housing/handle.
Figure 15:
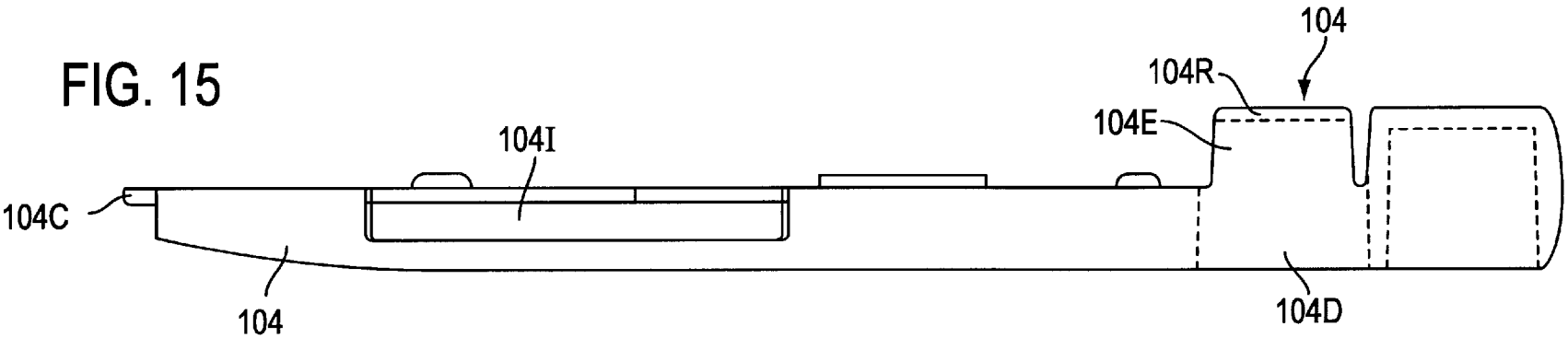
Figure 16:
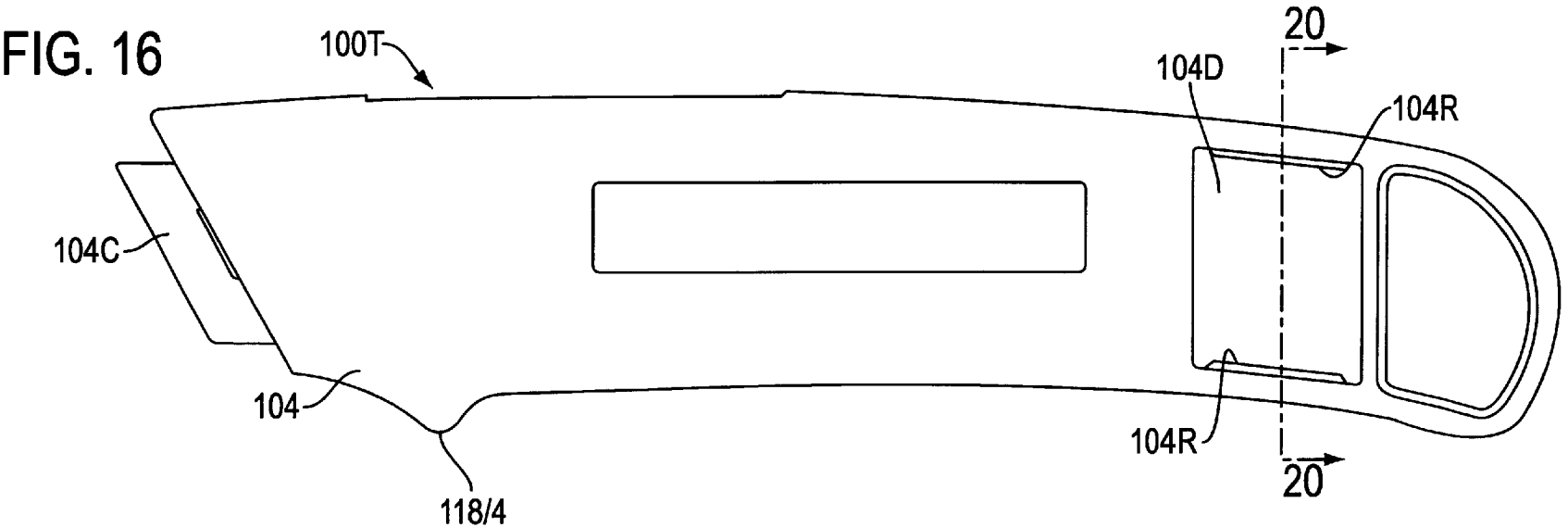
Figure 17:
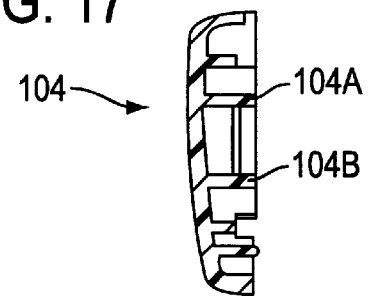
FIGS. 17 to 20 are sectional views respectively taken along the length of the second half of the housing.
Figure 18:
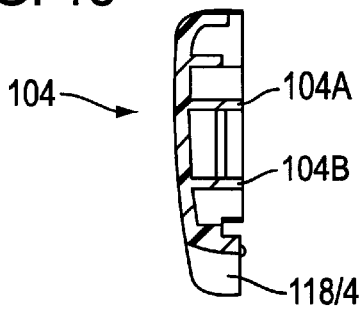
Figure 19:
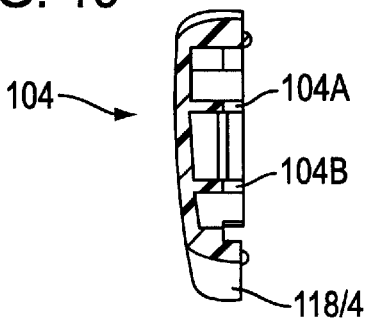
Figure 20:
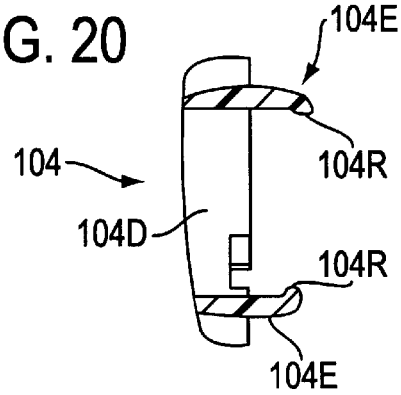
Figure 21:
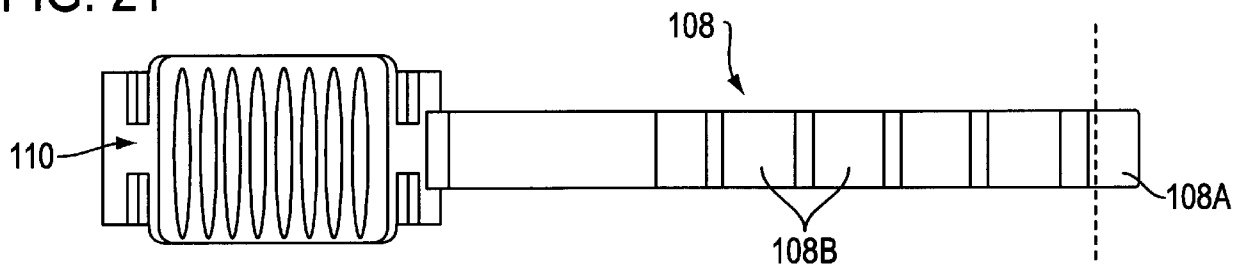
FIGS. 21 and 22 are respectively plan and side view of a serpentine spring and integral thumb piece which is used to move a blade carrier back and forth within the housing.
Figure 22:
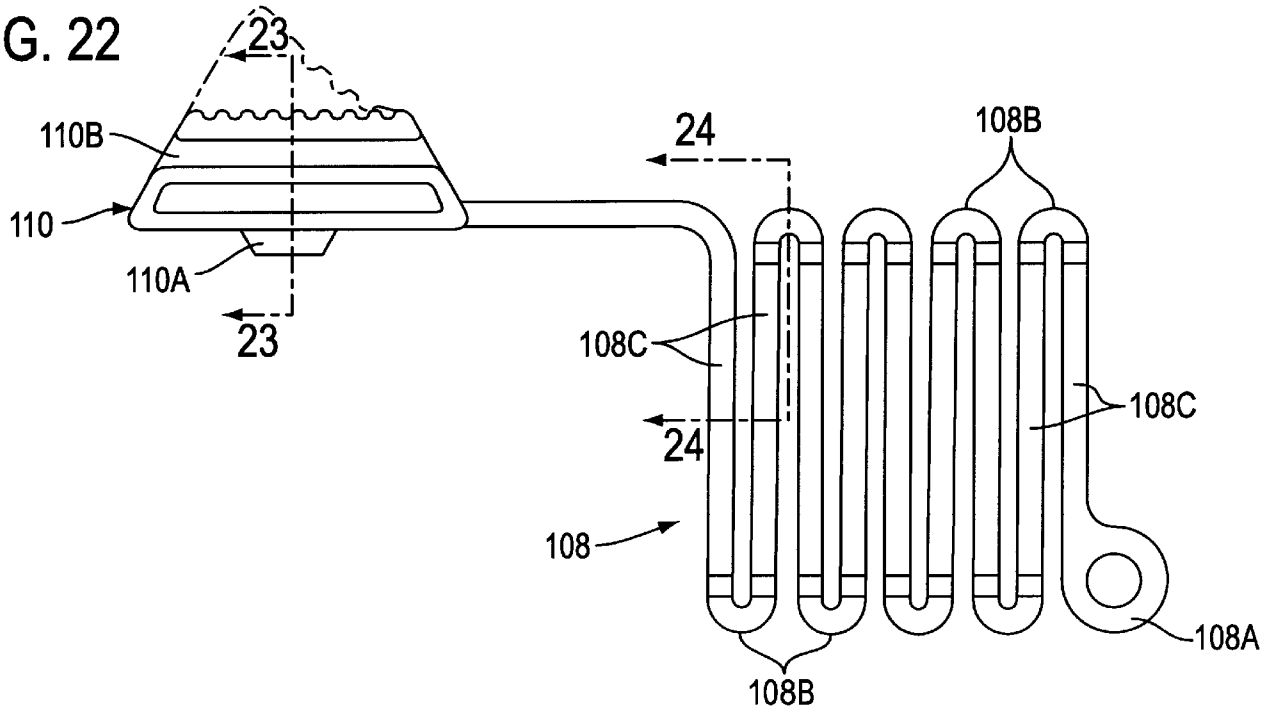
Figure 23:
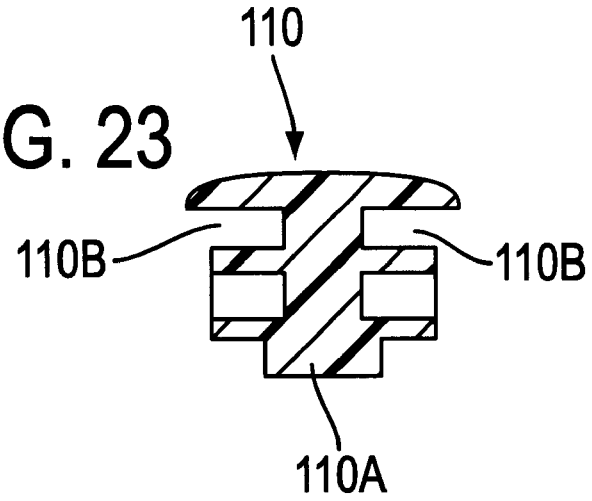
FIGS. 23 and 24 are respectively sectional views taken along section lines 23—23 and 24—24 of FIG. 22.

A finger guard 118 is provided on the lower minor edge of the housing. In this embodiment, the guard is formed from projections portions 118/2, 118/4 which are formed in the respective halves and which seat side by side when the two halves 102, 104 are connected to one another. A strengthening web 118/4A is, as shown in FIG. 14, provided in the projection portion 118/4 which is formed in the second half 104 of the housing. This guard member 118 is such as to provide an abutment which prevents the index finger of the operator from slipping forward toward the blade during a cutting operation.

While the finger guard 118 which is illustrated in the drawings is shown in the form of a single simply shaped projection, the invention is not so limited and it is possible, merely by way of example, to provide a more pronounced member or an arrangement wherein a pair of the projections are provided in a manner which are arranged to have the operator's index finger received therebetween and thus prevented from slipping either forward or backward during use of the device.

A blade storage area is provided within the housing. This area is, as indicated by the numeral 102ST in FIG. 8, such as to be located so as to be covered by the blade carrier when the carrier is disposed in position in the manner illustrated in FIG. 4, for example.

FIGS. 25–27 show details of the blade carrier 106. As mentioned above, the carrier 106 has a flat rear major surface 106B and also has a profiled front major surface 106D. This profiling includes shaped edge members 106E and 106F which are respectively formed along the upper and lower edges of the carrier 106 and which project out about the main planar portion of the front major surface. Both the upper and lower edges 106E, 106F are provided with the previously mentioned engagement recesses or openings 106B1, 106B2 and 106B3, 106B4 into which the engagement projection 110A formed on the lower surface of the thumb piece 110, can be selectively received.

The provision of the engagement recesses on both the upper and lower edges of the blade carrier 106 allows the carrier to be rotated through 180° so that the upper edge takes the position of the lower edge and vice versa., and rest in the first half in this new orientation. It will be noted that in this embodiment the recesses 106B1, 106B2 in the upper edge 106E are located essentially opposite the recesses 106B3, 106B4 which are formed in the lower edge. This close to mirror image arrangement is not necessary and the recesses can be arranged in different positions in accordance with the adjustment characteristics which are sought.

In the illustrated orientation or position, the blade carrier 106 is arranged to receive an essentially trapezoidally-shaped cutting blade in the manner indicated by the first icon IC1 which is imprinted into the front major surface . Examples of this type of blade are given in FIGS. 28–33. A will be noted, this type of blade is provided with at least one connection notch in its upper edge (viz., the edge opposite the cutting edge). The blade carrier is provided with a first positioning projection 106G which extends down from the upper edge member 106E in a manner that enables a blade to be set on the front major surface, in the manner indicated by the first icon, with the cutting edge seated on the lower edge 106F and with the positioning projection located in a connection notch formed in the upper edge of the blade.

As will be appreciated from FIG. 4, even if the blade is such as to have only one connection notch (e.g. the blade shown in FIG. 29), the maximum amount of blade projection can be adjusted by selecting the appropriate engagement recess (i.e., one of 106B1 and 106B2) in the edge of the blade carrier 106 which is in contact with the lower surface of the thumb piece 110. In this embodiment, since there are only two engagement recesses formed in each of the upper and lower edges of the carrier, the amount of adjustment is limited to only two stages. However, in the event that the blade is formed with more than one connection notch (see FIGS. 28 and 33 by way of example), then the degree of adjustment freedom is increased and the maximum amount of blade projection can be varied to a greater degree. The formation of three or more engagement recesses in the upper and lower edges of the carrier would also increase this freedom.

Figure 34:
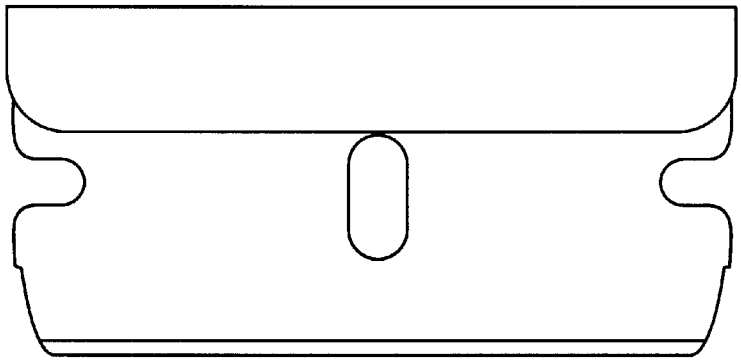
Figure 35:
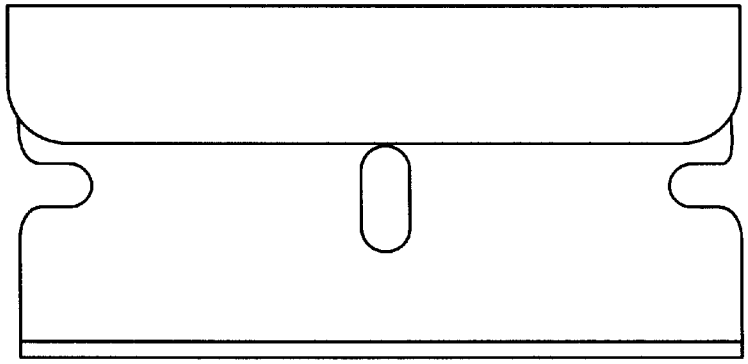

The blade carrier 106 is formed with a second positioning projection 106H. This projection is, as shown in FIG. 26, located toward a rear edge of the carrier (viz., rear as seen in FIG. 26) and is arranged to project up from a raised section 106I. This projection 106H is adapted for use with a razor blade of the nature illustrated in FIGS. 34 and 35 and is arranged to be received in the openings which are formed in the middle of the blade.

It will be understood from the second icon IC2 which is imprinted on the front major surface of the carrier, that when it is desired to use the razor type blade as different from the blades shown in FIGS. 28–33, the blade carrier needs to rotated through 180° from the illustrated orientation and set in the first half so that the cutting edge of the razor blade will project oriented downwardly in the required manner. It will of course be self-evident that the blade carrier 106 can be readily adapted to receive and operatively support a number of different blades and is limited to the illustrated arrangements.

The material from which the two halves 102, 104 are formed can be either opaque or transparent. It is also possible that one half be made of a transparent material and the other of an opaque type. Combinations of colored/patterned material is also possible. In fact, is possible to make the second half 104 transparent and make the components such the thumb piece 110, spring 108 and blade carrier 106 different colors so as to be visible through the transparent half. This arrangement of course renders the blade which is disposed on the blade carrier 106, visible to the operator, who immediately is aware of the type which is currently loaded and whether this is the type that is required for the job in hand.

By making the spring 108 and thumb piece 110 of a brightly colored material it is possible, in combination with the use of at least one transparent half, to increase the aesthetic value of the device by making the shape and operation of the spring visible to the operator. In addition to this, the operator is immediately made aware of the type of utility knife that is being used and enables an immediate differentiation between the type wherein the blade is automatically retracted and those wherein the blade is locked in position through the provision of a detent mechanism or the like.

Although the present invention has been disclosed with reference to only one specific embodiment, it will be self evident to those skilled in the art to which the present invention pertains, that various changes and modifications could be made without departing from the scope of the invention which is limited only by the appended claims.

That is to say, while the embodiment of the present invention is directed to the type of arrangement wherein the blade retracts automatically under the bias of a spring when the manual pressure which is used to force the blade out into a projected position, is removed, that various aspects of the invention could well be applied to the type of knife wherein the blade is locked in position using a lock or detent mechanism. By way of example, the blade carrier could be used in such an arrangement without need of modification and could be arranged, for example, so that one or more of the engagement recesses which are formed in the lower edge of the carrier, could be arranged to engage a catch or the like and thus serve a dual purpose.

The spring and thumb piece could be also transferred to other types of knives without major redesign. The finger guard arrangement could also be used without any particular difficulties. The unique connection arrangement which allows the two halves to be connected/separated with ease could also be applied to any number of different hand-held devices and thus represents a valuable design arrangement.

What is claimed is:

1. A utility knife comprising:

a manually grippable housing comprising first and second halves, the first and second halves cooperating to define an enclosed space therebetween; and connection means for permitting the first and second halves to be releasably connected to one another, said connection means comprising:

a) a shaped projection which is rigid with the first half; and b) a pair of resilient tabs formed on the second half, the pair of resilient tabs extending along opposed sides of said shaped projection to frictionally engage the opposed sides of the shaped projection and hold the first and second halves together;

a blade carrier disposed in the enclosed space, said blade carrier being slidable along elongate guide surfaces which project from at least one of the first and second halves;

a thumb piece which is slidably disposed in an elongate opening formed along an upper edge of the housing, the thumb piece being detachably connectable with the blade carrier through a plurality of connection sites formed on one of the thumb piece and the blade carrier to allow a position of the blade carrier relative to the thumb piece to be adjustable and for the degree of projection of a blade mounted on the blade carrier from the housing when the thumb piece is moved to one end of the elongate opening, to be selectively varied;

wherein the spring has a flat serpentine configuration, is unitarily connected with the thumb piece, and has a slot formed in the boss, the slot being adapted to receive a rib portion that is formed in one of the two halves in a manner to prevent the relative rotation; and wherein the flat serpentine configuration of the spring has a plurality of inflexion portions at which a direction of the spring changes, each of the inflexion portions having a dimension which is greater than corresponding dimension of portions of the spring which extend between and interconnect each of the inflexion portions.

2. A utility knife which has first and second halves which are detachably connectable to one another to form a housing, comprising:

a blade carrier slidably supported in the housing the blade carrier being configured so that it can be rotated through 180° from a first position wherein a first type of blade can be operatively set thereon, to a second position wherein a second type of blade which is different from the first, can be operatively set thereon;

a thumb piece which is slidably supported in the housing, the thumb piece having a projection which engages in a selected one of a plurality of connection apertures formed along opposed sides of the blade carrier in a manner which adjusts the relative position between the thumb piece and the blade carrier when the thumb piece is in drive connection with the blade carrier; and a flat serpentine spring which has one end rigidly connected to the thumb piece and which has a second end detachably connected to a connection member on an interior surface of one of the first and second halves of the housing; and wherein the serpentine spring has a plurality of inflexion portions at the locations where the spring changes direction, the inflexion portions having at least one structural dimension which is greater than a corresponding dimension of portions of the serpentine spring which extend between and interconnect the inflexion portions.

3. A utility knife as set forth in claim 2, wherein the serpentine spring is arranged to elongate in a longitudinal direction of the housing and wherein the at least one structural dimension is a width dimension taken at right angles to the direction in which the spring elongates.

4. A utility knife comprising:

a manually grippable housing comprising first and second halves, the first and second halves cooperating to define an enclosed space therebetween;

connection means for permitting the first and second halves to be releasably connected to one another, said connection means comprising:

a) a shaped projection which is rigid with the first half;

b) a pair of resilient tabs formed on the second half, the pair of resilient tabs extending along opposed sides of said shaped projection to clasp the opposed sides of the shaped projection therebetween and hold the first and second halves together; and a blade carrier disposed in the enclosed space, said blade carrier being slidable along elongate guide surfaces which project from at least one of the first and second halves;

wherein the blade, which is supported on the blade carrier, is structured to be set on the blade carrier in at least two different positions which determine the degree of projection of the blade from the housing when the blade carrier is manually urged to a blade extending position.

5. A utility knife comprising:

a manually grippable housing comprising first and second halves, the first and second halves cooperating to define an enclosed space therebetween;

connection means for permitting the first and second halves to be releasably connected to one another, said connection means comprising:

a) a shaped projection which is rigid with the first half;

b) a pair of resilient tabs formed on the second half, the pair of resilient tabs extending along opposed sides of said shaped projection to clasp the opposed sides of the shaped projection therebetween and hold the first and second halves together; and a blade carrier disposed in the enclosed space, said blade carrier being slidable along elongate guide surfaces which project from at least one of the first and second halves;

wherein the blade carrier has a structure which selectively receives two different blades and is disposable on the elongate guide surfaces in two distinct orientations.

6. A utility knife comprising:

a manually grippable housing comprising first and second halves, the first and second halves cooperating to define an enclosed space therebetween;

connection means for permitting the first and second halves to be releasably connected to one another, said connection means comprising:

a) a shaped projection which is rigid with the first half;

b) a pair of resilient tabs formed on the second half, the pair of resilient tabs extending along opposed sides of said shaped projection to clasp the opposed sides of the shaped projection therebetween and hold the first and second halves together; and a blade carrier disposed in the enclosed space, said blade carrier being slidable along elongate guide surfaces which project from at least one of the first and second halves;

wherein the blade carrier is structured to support a cutting blade in a plurality of positions.

7. A utility knife comprising:

first and second halves which cooperate to define a manually grippable housing;

a blade which is selectively projectable from a first end of the manually grippable housing; and a connection structure which releasably interconnects the first and second halves, and which comprises:

a shaped projection which is rigid with the first half and distal from the first end; and a pair of resilient tabs formed on the second half distal from the first end, the pair of resilient tabs being arranged with respect to one another so that they grip opposed sides of said shaped projection and frictionally engage the opposed sides of the shaped projection when the first and second halves are pressed together;

wherein the blade carrier can be disposed on a guide rail in a plurality of orientations and respectively support a plurality of different blades.

8. A utility knife which has first and second halves which are detachably connectable to one another to form a housing, comprising:

a blade carrier slidably supported in the housing and slidable between a first position within the housing wherein a blade, which is supported thereon, projects out of the housing to a cutting position wherein cutting with the blade is enabled, and a second position within the housing wherein the blade is retracted to a non-projected, non-cutting, safe position, the blade carrier being configured so that it can be rotated through 180° from a first position wherein a first type of blade can be operatively set thereon, to a second position wherein a second type of blade which is different from the first, can be operatively set thereon.

9. A utility knife as set forth in claim 8, further comprising: a thumb piece which is slidably supported in the housing, the thumb piece having a projection which engages in a selected one of a plurality of connection apertures formed along opposed sides of the blade carrier in a manner which adjusts the relative position between the thumb piece and the blade carrier when the thumb piece is in drive connection with the blade carrier.

10. A utility knife as set forth in claim 9, further comprising a finger rest, the finger rest comprising a projection located on a lower edge of the housing so as to be approximately opposite the thumb piece when the thumb piece is maximally moved toward a front portion of the housing from which the blade projects.

11. A utility knife as set forth in claim 9, further comprising a flat serpentine spring which has one end rigidly connected to the thumb piece and which has a second end detachably connected to a connection member on an interior surface of one of the first and second halves of the housing.

12. A utility knife as set forth in claim 8, wherein one of the first and second halves is made of a transparent material so that a serpentine spring which is disposed in the housing can be observed therethrough.

13. A utility knife having first and second halves which are detachably connected to one another to form a housing, and a blade carrier slidably disposed in the housing, comprising:

a flat serpentine spring which is disposed in the housing, the serpentine spring having a plurality of inflexion portions at the locations where the direction of the spring changes, the inflexion portions having at least one structural dimension which is greater than the corresponding dimension of the portions of the serpentine spring which extend between and interconnect the inflexion portions, the flat serpentine spring being separate from the blade carrier and connected thereto through an intermediate member.

14. A utility knife as set forth in claim 13, wherein the intermediate member is a thumb piece which is slidably disposed along an upper minor edge of the housing, the thumb piece being unitarily connected to one end of the serpentine spring.

15. A utility knife as set forth in claim 14, wherein the thumb piece is detachably connectable with the blade carrier through a plurality of connection sites formed on one of the thumb piece and the blade carrier to allow the relative position of the blade carrier with respect to the thumb piece to be adjustable and for the degree of projection of a blade mounted on the blade carrier from the housing when thumb piece is manually driven in a blade extending direction against a bias of the serpentine spring, to be selectively varied.

16. A utility knife as set forth in claim 14, wherein the first and second halves are shaped to form a finger rest which is located on a lower edge of the housing so as to be approximately opposite the thumb piece when the thumb piece is maximally moved toward a front portion of the housing from which the blade projects.

17. A utility knife as set forth in claim 14, wherein the first and second halves are provided with a connection arrangement for permitting the first and second halves to be releasably connected to one another, said connection arrangement comprising:

a) a shaped projection which is rigid with the first half; and b) a pair of resilient tabs formed on the second half, the pair of tabs extending along opposed sides of said projection to frictionally engage the opposed sides of the projection and hold the first and second halves together.

18. A utility knife as set forth in claim 13, wherein one of the first and second halves is made of a transparent material so that the serpentine spring can be observed therethough.

* * * * *